US010025230B2

(12) United States Patent
Oshima et al.

(10) Patent No.: US 10,025,230 B2
(45) Date of Patent: Jul. 17, 2018

(54) POSITION DETECTION APPARATUS THAT DETECTS POSITION OF TARGET OBJECT

(71) Applicant: CANON KABUSHIKI KAISHA, Tokyo (JP)

(72) Inventors: Kana Oshima, Ako (JP); Shusuke Miura, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/372,829

(22) Filed: Dec. 8, 2016

(65) Prior Publication Data

US 2017/0168442 A1 Jun. 15, 2017

(30) Foreign Application Priority Data

Dec. 14, 2015 (JP) ..... 2015-242984

(51) Int. Cl.
*G03G 15/16* (2006.01)
*G03G 15/00* (2006.01)

(52) U.S. Cl.
CPC ..... *G03G 15/1615* (2013.01); *G03G 15/5062* (2013.01); *G03G 2215/0016* (2013.01); *G03G 2215/00156* (2013.01); *G03G 2215/00168* (2013.01)

(58) Field of Classification Search
CPC ..... G03G 15/1605; G03G 15/1615; G03G 15/5054; G03G 2215/00143; G03G 2215/00151; G03G 2215/00156; G03G 2215/0016; G03G 2215/00168; B65H 2801/03; B65H 2801/06; B65H 2801/09; B65H 2801/12; B65H 2801/15;
(Continued)

(56) References Cited

U.S. PATENT DOCUMENTS 5,347,348 A * 9/1994 Nagata ..... B65G 23/44 198/810.03
8,391,759 B2 * 3/2013 Nakura ..... G03G 15/161 399/302

(Continued)

FOREIGN PATENT DOCUMENTS

JP 2001083840 A * 3/2001
JP 2010243791 A 10/2010

*Primary Examiner* — Carla Therrien
(74) *Attorney, Agent, or Firm* — Rossi, Kimms & McDowell LLP

(57) ABSTRACT

A position detection apparatus detects a position of a target object. One end of a swinging member contacts the target object, and the other end contacts a moving member. (M+1) pieces of sensors are arranged to output signals corresponding to a position of the moving member. Measured parts are disposed on the moving member along loci of measuring positions of the sensors. A detection unit detects the position of the target object based on the output signals of M pieces of sensors when the other sensor outputs a predetermined signal. The measured parts corresponding to the other sensor are provided in $2^M$ pieces of divided areas that are disposed along a locus corresponding to the other sensor. Each of the measured parts corresponding to the other sensor is disposed in a center portion except both ends in the moving direction in each of the divided areas.

10 Claims, 9 Drawing Sheets

(58) Field of Classification Search
CPC ..... B65H 2801/21; B65H 2511/242; B65H 2301/33; B65H 2601/272
See application file for complete search history.

(56) References Cited

U.S. PATENT DOCUMENTS

| | | | | |
|---|---|---|---|---|
| 8,412,081 | B2 * | 4/2013 | Kudo | G03G 15/161 198/810.03 |
| 9,846,399 | B2 * | 12/2017 | Oshima | G03G 15/5054 |
| 2006/0289280 | A1 * | 12/2006 | Furuya | G03G 15/1615 198/806 |
| 2011/0026983 | A1 * | 2/2011 | Okamoto | G03G 15/2064 399/302 |
| 2012/0082499 | A1 * | 4/2012 | Murakami | B41J 11/007 400/582 |
| 2012/0148299 | A1 * | 6/2012 | Yamamoto | G03G 15/1615 399/121 |
| 2013/0101323 | A1 * | 4/2013 | Nakagawa | G03G 15/0189 399/302 |
| 2014/0334856 | A1 * | 11/2014 | Nakagaki | G03G 15/1615 399/302 |
| 2016/0146640 | A1 * | 5/2016 | Chen | G01D 5/34715 250/231.13 |
| 2017/0060044 | A1 * | 3/2017 | Tsukijima | G03G 15/1615 |

* cited by examiner

POSITION DETECTION APPARATUS THAT DETECTS POSITION OF TARGET OBJECT

BACKGROUND OF THE INVENTION

Field of the Invention

The present invention relates to a position detection apparatus that detects a position of a target object.

Description of the Related Art

There is a known image forming apparatus that primarily transfers toner images respectively formed on a plurality of photosensitive members to an intermediate transfer belt and secondarily transfers a color image composited on the intermediate transfer belt to a recording material.

Incidentally, when the intermediate transfer belt in the image forming apparatus is deviated in a width direction that intersects perpendicularly with a belt conveying direction, color misregistration in which the toner images of the plurality of colors on the intermediate transfer belt are deviated may occur. In order to prevent generating such color misregistration, there is a known correction control that detects a deviation amount in the width direction that intersects perpendicularly with the belt conveying direction of the intermediate transfer belt and that corrects belt driving corresponding to the deviation amount.

As an apparatus that detects a deviation amount of an intermediate transfer belt, there is a proposed apparatus that is provided with a swinging arm that is in contact with an edge of the intermediate transfer belt and swings and two optical sensors that are arranged on the swinging arm so as to shift in a longitudinal direction thereof that is the conveyance direction of the intermediate transfer belt. In this belt-deviation-amount detection apparatus, the swinging arm swings corresponding to the deviation amount of the intermediate transfer belt. And a result of whether the deviation amount of the belt falls in tolerance is detected using changes of the signals from the two optical sensors on the swinging arm due to swinging (for example, see Japanese Laid-Open Patent Publication (Kokai) No. 2010-243791 (JP 2010-243791A)). Moreover, this belt-deviation-amount detection apparatus detects the deviation amount of the belt in five levels.

However, the above-mentioned conventional apparatus is easily affected by variations of the sensor positions and skew of a target object (belt), and particularly, there is a problem of erroneous detection near a boundary between adjacent deviation levels.

SUMMARY OF THE INVENTION

An aspect of the present invention provides a position detection apparatus that detects a position of a target object in a predetermined direction, the position detection apparatus including a swinging member of which one end is in contact with the target object in the predetermined direction, a moving member that is in contact with the other end of the swinging member, (M+1) pieces of sensors that are arranged in a direction that intersects a moving direction of the moving member and output signals corresponding to a position of the moving member that corresponds to a swinging amount of the swinging member, and a detection unit configured to detect the position of the target object based on the signals output from the sensors. The moving member has a plurality of measured parts disposed on the moving member along a plurality of loci of measuring positions of the sensors formed on the moving member during movement of the moving member. The detection unit detects the position of the target object based on the output signals of M pieces of sensors among the (M+1) pieces of sensors in a case where the predetermined sensor other than the M pieces of sensors outputs a predetermined signal. The measured parts corresponding to the measuring position of the predetermined sensor are provided in $2^M$ pieces of divided areas that are disposed along a locus corresponding to the predetermined sensor, and each of the measured parts corresponding to the measuring position of the predetermined sensor is disposed in a center portion except both ends in the moving direction in each of the divided areas.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
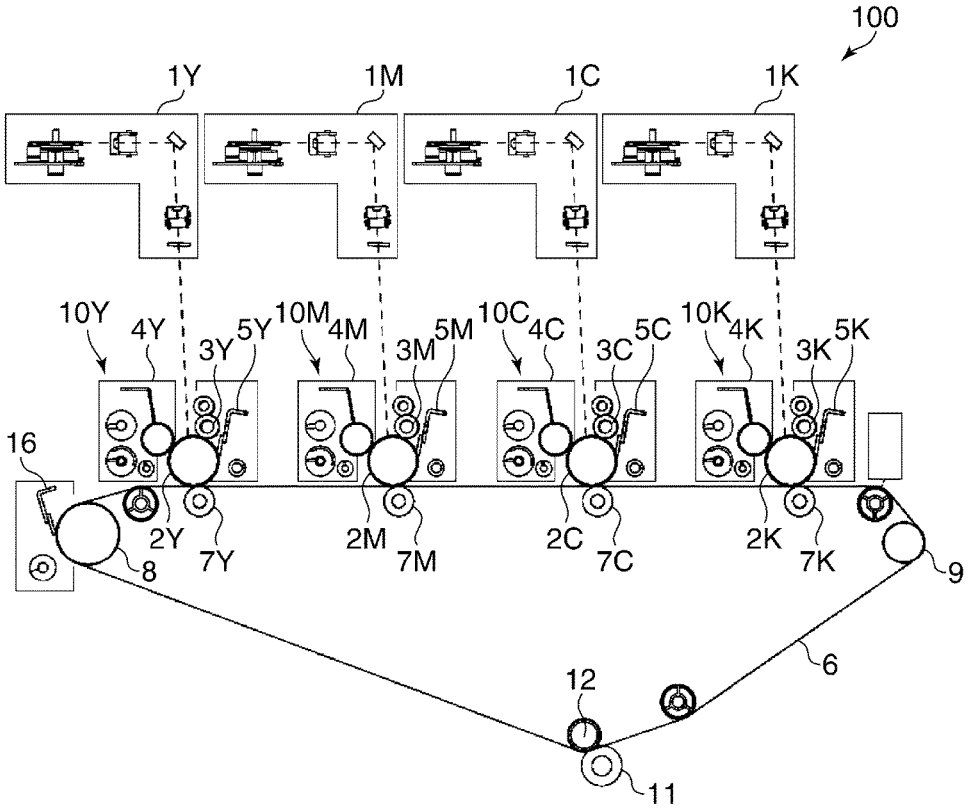
FIG. 1 is a sectional view schematically showing a configuration of an image forming apparatus according to a first embodiment.

FIG. 1 is a sectional view schematically showing a configuration of an image forming apparatus according to a first embodiment. As shown in FIG. 1, the image forming apparatus 100 is provided with an intermediate transfer belt 6 as a target object of position detection and a plurality of image forming stations 10Y, 10M, 10C, and 10K that are arranged along a horizontal part of the intermediate transfer belt 6.

The image forming stations 10Y, 10M, 10C, and 10K are respectively provided with photosensitive drums 2Y, 2M, 2C, and 2K as photosensitive members, charging rollers 3Y, 3M, 3C, and 3K that are respectively arranged around the photosensitive drums 2Y, 2M, 2C, and 2K, and laser scanner units 1Y, 1M, 1C, and 1K. Each of the photosensitive drums 2Y, 2M, 2C, and 2K is configured by applying an organic photoconductive layer to a periphery of an aluminum cylinder, and is rotated counterclockwise by a driving force transferred from a drive motor (not shown), for example.

The charging rollers 3Y, 3M, 3C, and 3K electrify uniformly the surfaces of the corresponding photosensitive drums 2Y, 2M, 2C, and 2K, respectively. The laser scanner units 1Y, 1M, 1C, and 1K respectively form electrostatic latent images on the surfaces of the corresponding photosensitive drums 2Y, 2M, 2C, and 2K by exposing the photosensitive drums 2Y, 2M, 2C, and 2K selectively on the basis of image data sent from a controller (not shown).

The image forming stations 10Y, 10M, 10C, and 10K are respectively provided with development devices 4Y, 4M, 4C, and 4K, drum cleaners 5Y, 5M, 5C, and 5K, and primary transfer rollers 7Y, 7M, 7C, and 7K that are disposed oppositely to the photosensitive drums through the intermediate transfer belt 6, respectively. The development devices 4Y, 4M, 4C, and 4K are respectively provided with developing sleeves and stirring conveyance members which stir developer, and develop electrostatic latent images by supplying developer to the surfaces of the photosensitive drums 2Y, 2M, 2C, and 2K. The drum cleaners 5Y, 5M, 5C, and 5K respectively collect residual toners on the surface of the photosensitive drums 2Y, 2M, 2C, and 2K after primarily transferring. The collected residual toners are stored in a cleaner container (not shown).

The intermediate transfer belt 6 is an endless belt, and is looped over a plurality of rollers including a driving roller 8, deviation control roller 9, and secondary transfer internal roller 12. The intermediate transfer belt 6 is in slidably contact with the photosensitive drums 2Y, 2M, 2C, and 2K, is rotatably driven in clockwise in FIG. 1, and receives transfer of visible images from the photosensitive drums 2Y, 2M, 2C, and 2K. The visible images transferred to the intermediate transfer belt 6 are superimposed to form a color image.

A secondary transfer external roller 11 is arranged oppositely to the secondary transfer internal roller 12. The contact part of the secondary transfer internal roller 12 and secondary transfer external roller 11 becomes a secondary transfer area. A transfer sheet is supplied to the secondary transfer area so as to synchronize with the color image formed on the intermediate transfer belt 6 that is rotating, and the color image on the intermediate transfer belt 6 is transferred to the transfer sheet. The secondary transfer external roller 11 is in contact with the intermediate transfer belt 6 while the color image is formed on the intermediate transfer belt 6, and detaches from the intermediate transfer belt 6 after completing the transfer.

A belt cleaner 16 that cleans the intermediate transfer belt 6 is arranged oppositely to the driving roller 8 through the intermediate transfer belt 6. The belt cleaner 16 collects residual toner on the intermediate transfer belt 6 after the secondary transfer. The collected residual toner is stored in a cleaner container (not shown).

Next, an intermediate transfer mechanism of the image forming apparatus in FIG. 1 will be described.

Figure 2:
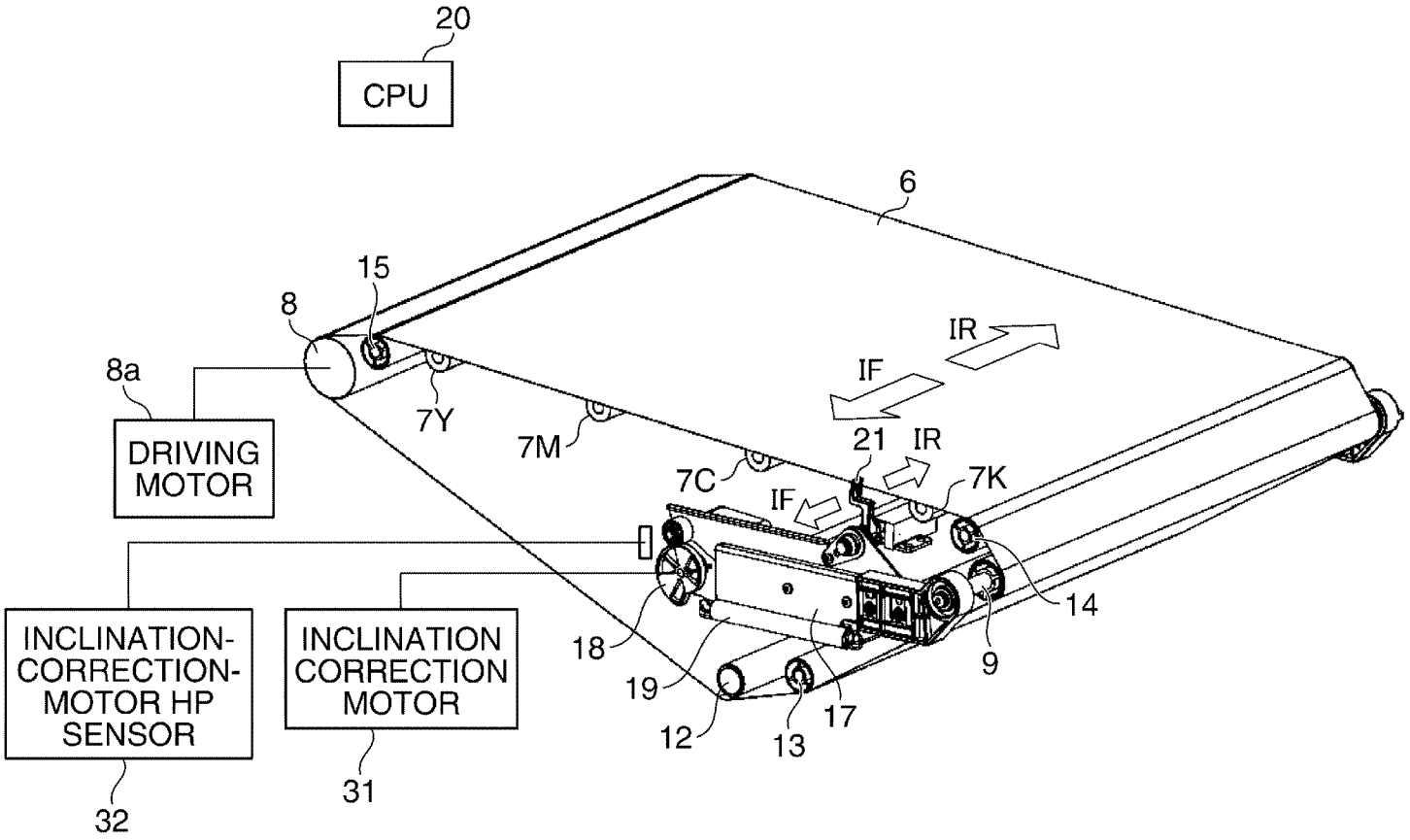
FIG. 2 is a perspective view showing an intermediate transfer mechanism in the image forming apparatus in FIG. 1.

FIG. 2 is a perspective view showing the intermediate transfer mechanism in the image forming apparatus in FIG. 1.

As shown in FIG. 2, the intermediate transfer belt 6 is looped over the driving roller 8, the deviation control roller 9, the secondary transfer internal roller 12, idler rollers 13 through 15, etc. The intermediate transfer belt 6 rotates so as to be in slidably contact with the primary transfer rollers 7Y, 7M, 7C, and 7K of the image forming stations 10Y, 10M, 10C, and 10K corresponding to colors of yellow (Y), magenta (M), cyan (C), and black (K).

The surface of the driving roller 8 is formed by a rubber layer. The driving roller 8 is rotated clockwise by a driving motor 8*a*, and rotates the intermediate transfer belt 6 by the friction between the rubber layer and the internal surface of the intermediate transfer belt 6. Moreover, the driving roller 8 functions as a counter roller of the belt cleaner 16 (FIG. 1), and receives pressure of a cleaning blade.

The deviation control roller 9 corrects deviation of the intermediate transfer belt 6. The far side of the deviation control roller 9 in the longitudinal direction thereof is fixed. Rotation of a deviation correction cam 18 changes inclination of the deviation control roller 9 through a deviation correction arm 17 to correct the deviation of the intermediate transfer belt 6. Moreover, a tension spring 19 (a far side is not shown) pressurizes the deviation control roller 9 in the outside direction of the intermediate transfer belt 6, which stretches the intermediate transfer belt 6.

The secondary transfer internal roller 12 is a counter roller that backs up the secondary transfer external roller 11 at the time of transferring the color image formed on the intermediate transfer belt 6 to the transfer sheet. The idler rollers 13 through 15 are stretching rollers that stretch the intermediate transfer belt 6. Particularly, the idler roller 13 is adjusting the posture of the intermediate transfer belt 6 so that the transfer sheet enters into the secondary transfer area along the intermediate transfer belt 6. Moreover, the idler rollers 14 and 15 are adjusting the posture of the intermediate transfer belt 6 so that the plurality of primarily transferring positions formed at the contact parts between the photosensitive drums 2Y, 2M, 2C, and 2K and the primary transfer rollers 7Y, 7M, 7C, and 7K may be maintained in approximately linear shapes.

The intermediate transfer mechanism has an inclination correction motor 31, inclination-correction-motor HP sensor 32, and CPU 20 that controls them. The CPU 20 detects a moving amount of a moving member and a deviation amount of the intermediate transfer belt 6 (a moving amount of a target object) on the basis of detection results of optical sensors in a belt-deviation-amount detection apparatus (a position detection apparatus) mentioned later, and corrects deviation of the intermediate transfer belt 6 by controlling the inclination correction motor.

Next, a belt-deviation-amount detection apparatus that detects the deviation amount of the intermediate transfer belt in the image forming apparatus 100 will be described.

Figure 3A:
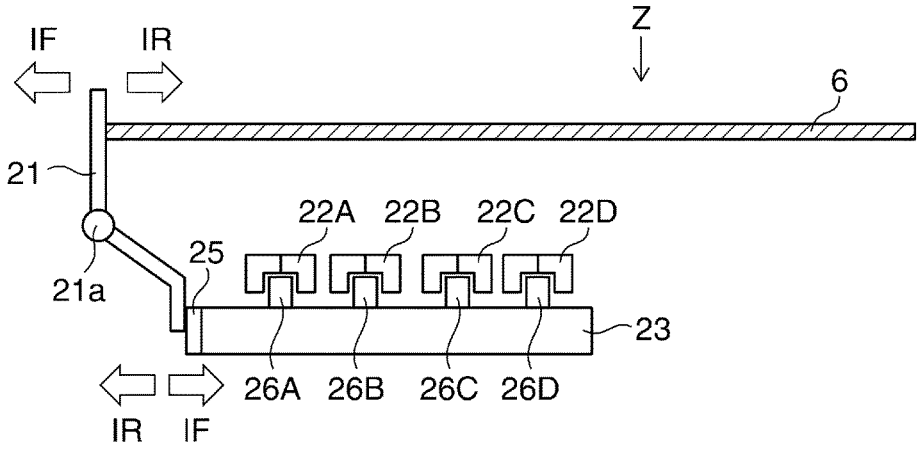
FIG. 3A and FIG. 3B are views schematically showing a configuration of a belt-deviation-amount detection apparatus in the image forming apparatus in FIG. 1.
Figure 3B:
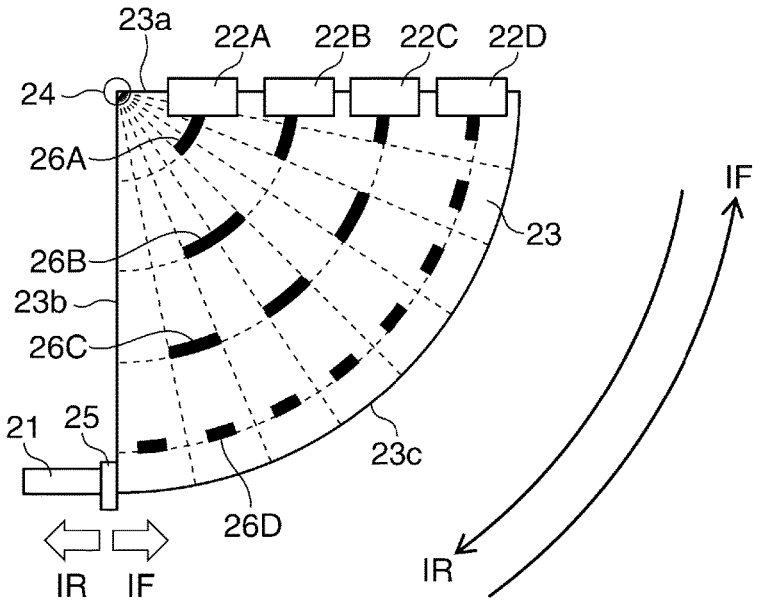

FIG. 3A and FIG. 3B are views schematically showing a configuration of the belt-deviation-amount detection apparatus in the image forming apparatus in FIG. 1. FIG. 3A is a sectional view that is vertical to the belt conveyance direction, and FIG. 3B is a plan view showing a rotating member 23 in FIG. 3A viewed in a direction of an arrow Z. It should be noted that an arrow IF in FIG. 3B indicates a direction of applied force that is generated when the intermediate transfer belt 6 deviates leftward in FIG. 3A, and an arrow IR indicates a direction of applied force that is generated when the intermediate transfer belt 6 deviates rightward in FIG. 3A.

In FIG. 3A and FIG. 3B, the rotating member 23 as a moving member formed in a fan shape in a plan view is rotatably arranged under the intermediate transfer belt 6. Two sides 23*a* and 23*b* of the rotating member 23 forms 90 degrees, for example. A pivot of the fan shape that is an intersection of the sides 23*a* and 23*b* serves as a rotating shaft 24. A plurality of optical sensors (N pieces of optical sensors) are arranged over the rotating member 23 in the direction that intersects the rotating direction (moving direction) of the rotating member 23. In this example, four transmission optical sensors 22A, 22B, 22C, and 22D are arranged in the longitudinal direction of the side 23*a*.

A plurality of projection groups 26A, 26B, 26C, and 26D are disposed on the rotating member 23 along a plurality of loci of the transmission optical sensors 22A, 22B, 22C, and 22D that are formed on the rotating member 23 by rotating the rotating member 23 around the rotating shaft 24. It should be noted that the projection group 26A has one projection on the same circumference. Similarly, the projection group 26B has two projections, the projection group 26C has four projections, and the projection group 26D has eight projections. The projection groups 26A, 26B, 26C, and 26D disposed on the moving member (the rotating member 23) function as shading member groups to the transmission optical sensors 22A, 22B, 22C, and 22D. It should be noted that the rotating member 23 is made from optically transparent material. Four light sources are disposed under the rotating member 23 so as to be arranged oppositely to the transmission optical sensors 22A, 22B, 22C, and 22D, respectively, through the rotating member 23. The light sources respectively irradiate the transmission optical sensors 22A, 22B, 22C, and 22D with lights that transmit the rotating member 23.

The rotating member 23 of such a configuration is divided into eight rotating areas θ1 through θ8 corresponding to unit arcs that divide a circular arc portion 23*c* into eight equally, for example (see FIG. 4 and FIG. 5A through FIG. 5H mentioned later). The reason why the rotating member 23 is divided into the eight rotating areas θ1 through θ8 will be described in detail with reference to FIG. 4 and FIG. 5A through FIG. 5H later.

The projection groups 26A, 26B, 26C, and 26D disposed on the rotating member 23 along the loci of the transmission optical sensors 22A, 22B, 22C, and 22D are arranged so that a combination of output signals of the transmission optical sensors 22A, 22B, 22C, and 22D at the time of reading is different for every rotating area among the rotating areas θ1 through θ8. Arrangement of the projection groups will be described later with reference to FIG. 4.

One end of a swinging arm 21 as a swinging member is in contact with the edge of the intermediate transfer belt 6 in the width direction that intersects perpendicularly with the rotating direction of the intermediate transfer belt 6. The other end across a swinging shaft 21*a* is in contact with a contact surface 25 of the rotating member 23. The contact surface 25 is disposed at the side surface near the circular arc portion 23*c* of the fan shape.

The swinging arm 21 swings around the swinging shaft 21*a* corresponding to the deviation amount of the intermediate transfer belt 6, and the other end that is in contact with the contact surface 25 pushes the contact surface 25 and rotates the rotating member 23 in the direction of the arrow IF, for example. It should be noted that the rotating member 23 is always energized in the direction of the arrow IR by the spring member in FIG. 3B. The combination of the projections of the projection groups 26A, 26B, 26C, and 26D that respectively face the transmission optical sensors 22A, 22B, 22C, and 22D vary corresponding to the rotation angle Δθ of the rotating member 23. As a result of this, the combination of the output signals of the transmission optical sensors 22A, 22B, 22C, and 22D varies.

The transmission optical sensors 22A, 22B, 22C, and 22D shall output an output signal "1", for example, when the projections of the projection groups 26A, 26B, 26C, and 26D as shading member groups shield the incident lights. On the other hand, the transmission optical sensors 22A, 22B, 22C, and 22D shall output an output signal "0", for example, when the projections do not shield the incident lights (i.e., when the incident lights are received).

Figure 4:
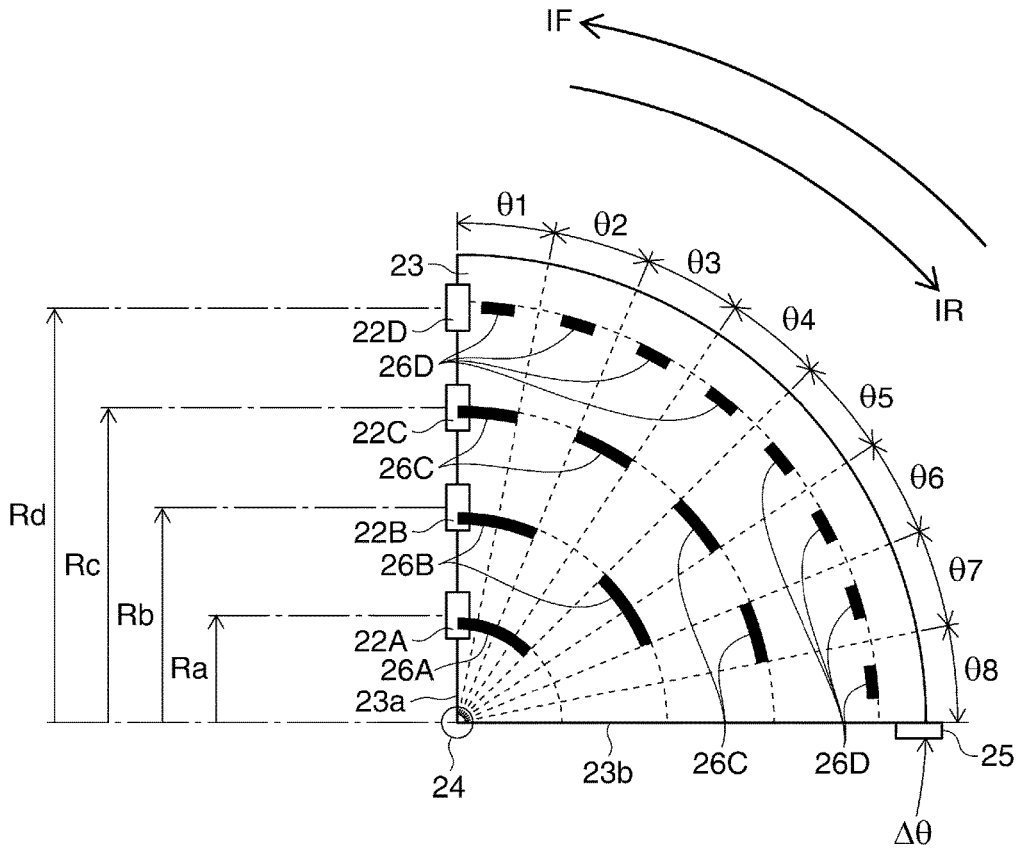
FIG. 4 is a view showing an example of an arrangement of projection groups on a rotating member of the belt-deviation-amount detection apparatus in FIG. 3A and FIG. 3B.

FIG. 4 is a view showing an example of an arrangement of the projection groups 26A, 26B, 26C, and 26D on the rotating member 23.

In FIG. 4, the four transmission optical sensors 22A, 22B, 22C, and 22D are arranged sequentially from the position near the rotating shaft 24 over the rotating member 23 along the side 23*a* in the radius direction of the fan shape. The distance from the rotating shaft 24 to the transmission optical sensors 22A, 22B, 22C, and 22D are Ra, Rb, Rc, and Rd, respectively. The projections of the arc-shaped projection groups 26A, 26B, 26C, and 26D are disposed on the rotating member 23 at the radius positions that respectively correspond to the transmission optical sensors 22A, 22B, 22C, and 22D so that the combination of the projections is different for every rotating area among the rotating areas θ1 through θ8.

The projection of the projection group 26A that faces the transmission optical sensor 22A is formed in the rotating areas θ1 through θ4 at the position of the radius Ra from the rotating shaft 24. Moreover, the projections of the projection group 26B that face the transmission optical sensor 22B are formed in the rotating areas θ1, θ2, θ5, and θ6 at the positions of the radius Rb from the rotating shaft 24. Moreover, the projections of the projection group 26C that face the transmission optical sensor 22C are formed in the rotating areas θ1, θ3, θ5, and θ7 at the positions of the radius Rc from the rotating shaft 24. Moreover, the projection of the projection group 26D that faces the transmission optical sensor 22D is formed in the center portion except both ends in the rotating direction (moving direction) in each of the rotating areas θ1 through θ8 at the positions of the radius Rd from the rotating shaft 24.

Table 1 shows the output signals of the three transmission optical sensors 22A, 22B, and 22C among the transmission optical sensors 22A, 22B, 22C, and 22D in FIG. 4 for each of the rotating areas θ1 through θ8.

TABLE 1

| | 22A | 22B | 22C |
|---|---|---|---|
| θ1 | 1 | 1 | 1 |
| θ2 | 1 | 1 | 0 |
| θ3 | 1 | 0 | 1 |
| θ4 | 1 | 0 | 0 |
| θ5 | 0 | 1 | 1 |
| θ6 | 0 | 1 | 0 |
| θ7 | 0 | 0 | 1 |
| θ8 | 0 | 0 | 0 |

In the table 1, the combination of the output signals of the transmission optical sensors 22A, 22B, and 22C is different in each of the eight rotating areas θ1 through θ8. Accordingly, it is understood that the projection groups 26A, 26B, and 26C are arranged so that the combination of the output signals of the transmission optical sensors 22A, 22B, and 22C is different for every rotating area.

Moreover, FIG. 5A through FIG. 5H are views showing the rotating positions of the rotating member 23 where the rotating areas θ1 through θ8 face the transmission optical sensors 22A, 22B, 22C, and 22D.

Figure 5A:
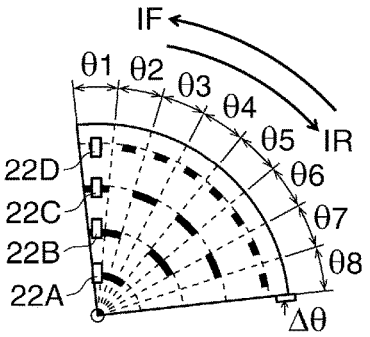
FIG. 5A through FIG. 5H are views showing rotating positions of a rotating member where rotating areas respectively face transmission optical sensors of the belt-deviation-amount detection apparatus in FIG. 3A and FIG. 3B.
Figure 5B:
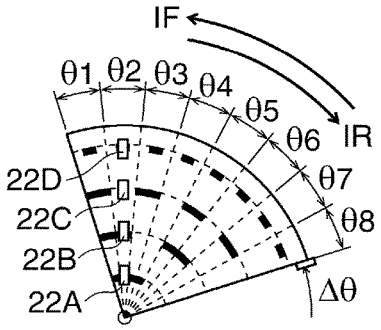
Figure 5C:
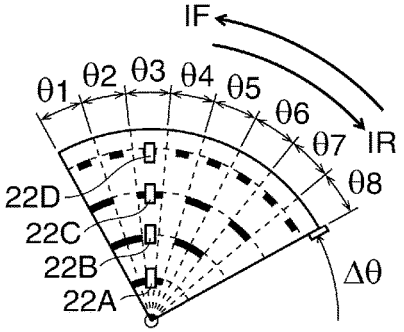
Figure 5D:
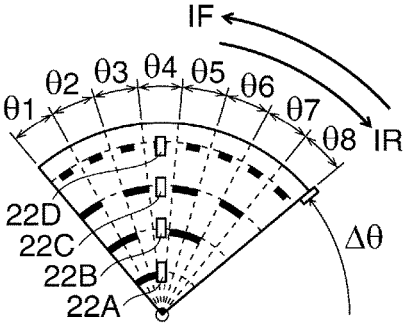
Figure 5E:
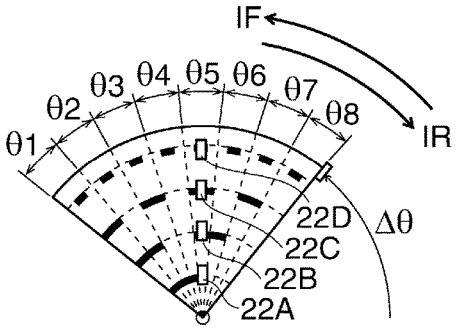
Figure 5F:
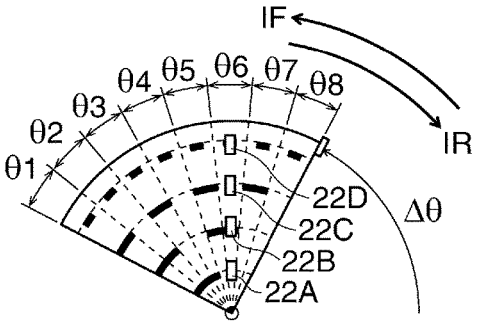
Figure 5G:
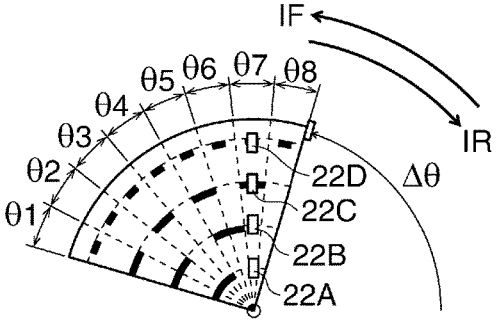
Figure 5H:
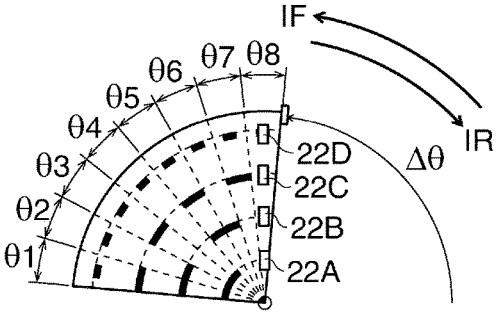

FIG. 5A shows the rotating position of the rotating member 23 where the rotating area θ1 faces the transmission optical sensors 22A, 22B, 22C, and 22D. FIG. 5B shows the rotating position of the rotating member 23 where the rotating area θ2 faces the transmission optical sensors 22A, 22B, 22C, and 22D. Moreover, FIG. 5C shows the rotating position of the rotating member 23 where the rotating area θ3 faces the transmission optical sensors 22A, 22B, 22C, and 22D. FIG. 5D shows the rotating position of the rotating member 23 where the rotating area θ4 faces the transmission optical sensors 22A, 22B, 22C, and 22D. Moreover, FIG. 5E shows the rotating position of the rotating member 23 where the rotating area θ5 faces the transmission optical sensors 22A, 22B, 22C, and 22D. FIG. 5F shows the rotating position of the rotating member 23 where the rotating area θ6 faces the transmission optical sensors 22A, 22B, 22C, and 22D. Furthermore, FIG. 5G shows the rotating position of the rotating member 23 where the rotating area θ7 faces the transmission optical sensors 22A, 22B, 22C, and 22D. FIG. 5H shows the rotating position of the rotating member 23 where the rotating area θ8 faces the transmission optical sensors 22A, 22B, 22C, and 22D.

In the belt-deviation-amount detection apparatus equipped with the rotating member 23 and the transmission optical sensors 22A, 22B, 22C, and 22D of such a configuration, the deviation amount of the intermediate transfer belt 6 is detected with using the combination of the output signals of the transmission optical sensors 22A, 22B, and 22C. Namely, the deviation amount of the intermediate transfer belt 6 is detected with using the combination of the output signals of M types (three types) of the transmission optical sensors corresponding to M types (three types) of the projection groups 26A, 26B, and 26C except one type among N types (four types) of the projection groups in the embodiment.

As shown in FIG. 4 and FIG. 5A through FIG. 5H, the projection of the projection group 26A is disposed in the rotating areas θ1 through θ4, the projections of the projection group 26B are disposed in the rotating areas θ1, θ2, θ5, and θ6, and the projections of the projection group 26C are disposed in the rotating areas θ1, θ3, θ5, and θ7.

Hereinafter, the reason why the rotating member 23 is divided into the eight rotating areas θ1 through θ8, and the reason why the projection groups 26A, 26B, and 26C are arranged as mentioned above are described.

As mentioned above, the rotating angle Δθ of the rotating member 23 that corresponds to the deviation amount of the intermediate transfer belt 6 is detected with using the three transmission optical sensors 22A, 22B, and 22C among the four transmission optical sensors 22A, 22B, 22C, and 22D in the embodiment.

Accordingly, it is first considered how many combinations the output signals of the three transmission optical sensors 22A, 22B, and 22C give. One sensor is able to output two statuses of ON and OFF. There are three sensors. Accordingly, the output signals of three sensors give eight combinations (i.e., $2^3=8$). Accordingly, the surface of the rotating member 23 is divided into the eight rotating areas θ1 through θ8, and the projection groups 26A, 26B, and 26C as the light shielding members so that the combination differs for every area. As a result of this, one of the rotating areas θ1 through θ8 that the sensors face is specified by specifying the combination of the output signals obtained from the three transmission optical sensors 22A, 22B, and 22C. Since the transmission optical sensors 22A, 22B, and 22C are fixed at home positions, the rotating angle Δθ of the rotating member 23 is detected by specifying one of the rotating areas θ1 through θ8 that the sensors face. When the rotating angle Δθ of the rotating member 23 is detected, the deviation amount of the intermediate transfer belt 6 is detected based on the moving amount of the swinging arm 21.

However, erroneous detection may occur in a boundary of rotating areas according to lack of followability to change of a measuring object of the transmission optical sensors.

Specifically, a case where the transmission optical sensors 22A, 22B, and 2C face the boundary of the rotating areas θ4 and θ5 while the rotating member 23 rotates so that the rotating area that faces the transmission optical sensors 22A, 22B, and 22C varies from θ4 to θ5 is assumed. Then, the transmission optical sensors 22A, 22B, and 22C shall face the region in the rotating area θ5 near the rotating area θ4. In this state, the transmission optical sensors 22B and 22C shall output the output signals "1" that are correct signals in the rotating area θ5, and the transmission optical sensor 22A shall erroneously output the output signal "1" that is an incorrect signal in the rotating area θ5 but is correct in the rotating area θ4 that had faced until now.

In this case, the combination of the output signals of the three transmission optical sensors 22A, 22B, and 22C are "1", "1", and "1", and the detection area is erroneously detected as the rotating area θ1. If the detection area by the sensors suddenly varies from the rotating area θ5 to θ1, it is erroneously detected that the intermediate transfer belt 6 rapidly deviates in the IR direction. Accordingly, the deviation control roller 9 controls so as to move the intermediate transfer belt 6 in the opposite direction to correct the deviation.

However, since the actual deviation amount of the intermediate transfer belt 6 is small deviation that the transmission optical sensors 22A, 22B, and 22C move the boundary of the rotating areas θ4 and θ5, the intermediate transfer belt 6 excessively deviates in the IF direction regardless of the correction. Moreover, in this case, a excessive deviation error may occur due to excessive deviation of the intermediate transfer belt 6, and the intermediate transfer belt 6 may run on an edge member and corrupt.

Accordingly, the embodiment employs the projection group 26D, which is not applied to detect the deviation amount of the intermediate transfer belt 6 among the four projection groups 26A, 26B, 26C, and 26D, and the transmission optical sensor 22D that faces the projection group 26D to prevent erroneous detection that likely occurs near a boundary of rotating areas (i.e., a boundary of deviation levels).

Table 2 shows the combinations of the output signals that are used to detect the belt deviation amount corresponding to FIG. 5A through FIG. 5H among the combinations of the output signals of the transmission optical sensors 22A, 22B, 22C, and 22D.

TABLE 2

| | 22A | 22B | 22C | 22D | SENSOR READ |
|---|---|---|---|---|---|
| θ1 | 1 | 1 | 1 | 1 | READ |
| θ1~θ2 | — | — | — | 0 | NOT READ |
| θ2 | 1 | 1 | 0 | 1 | READ |
| θ2~θ3 | — | — | — | 0 | NOT READ |
| θ3 | 1 | 0 | 1 | 1 | READ |
| θ3~θ4 | — | — | — | 0 | NOT READ |
| θ4 | 1 | 0 | 0 | 1 | READ |
| θ4~θ5 | — | — | — | 0 | NOT READ |
| θ5 | 0 | 1 | 1 | 1 | READ |
| θ5~θ6 | — | — | — | 0 | NOT READ |
| θ6 | 0 | 1 | 0 | 1 | READ |
| θ6~θ7 | — | — | — | 0 | NOT READ |
| θ7 | 0 | 0 | 1 | 1 | READ |

TABLE 2-continued

| | 22A | 22B | 22C | 22D | SENSOR READ |
|---|---|---|---|---|---|
| θ7~θ8 | — | — | — | 0 | NOT READ |
| θ8 | 0 | 0 | 0 | 1 | READ |

As shown in the table 2, only when the output signal of the transmission optical sensor 22D is "1", the output signals of the transmission optical sensors 22A, 22B, and 22C are read, and the rotating angle Δθ of the rotating member 23 that corresponds to the deviation amount of the intermediate transfer belt 6 is detected. On the other hand, when the output signal of the transmission optical sensor 22D is "0", the output signals of the other sensors are not read, and the previous rotating angle Δθ that has been detected at the last time is continuously used as the rotating angle of the rotating member 23. This prevents erroneous detection because the output signals detected near a boundary of rotating areas (deviation levels) at which the measuring object varies are excepted from the detection process of the rotating angle Δθ of the rotating member 23.

In the embodiment, shading parts of M types (three types) of the shading member groups are disposed in the plurality of areas formed by dividing the rotating member that rotates depending on the deviation amount of the intermediate transfer belt 6 so that the output signals of M pieces of corresponding optical sensors give $2^M$ (eight) combinations. Moreover, a shading part of one shading member group other than the above-mentioned M types of the shading member groups is formed in the center portion except both ends in the rotating direction in each of the divided eight areas. Then, the rotating angle Δθ of the rotating member 23 that moves according to the deviation of the intermediate transfer belt that corresponds to the deviation amount of the intermediate transfer belt is detected with using the combination of the output signals of M pieces (three pieces) of the sensors at the time when the transmission optical sensor 22D that faces the one shading member group outputs the predetermined signal "1". This prevents erroneous detection near a boundary of deviation levels.

Although the deviation amount of the intermediate transfer belt 6 is detected by detecting the rotating angle Δθ of the rotating member 23 from the eight ($=2^3$) rotating areas with using the three transmission optical sensors in the embodiment, the number of the transmission optical sensors is not limited particularly. When the number of the transmission optical sensors is increased and the rotating member 23 is divided into more areas correspondingly, the resolution of the detectable belt deviation amount is improved.

Next, a second embodiment of the present invention will be described.

Figure 6A:
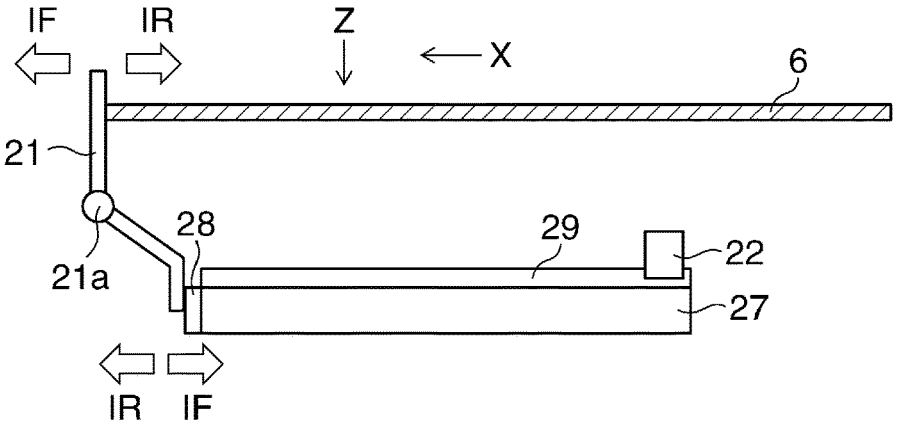
FIG. 6A, FIG. 6B, and FIG. 6C are views schematically showing a configuration of a belt-deviation-amount detecting apparatus in a second embodiment.
Figure 6B:
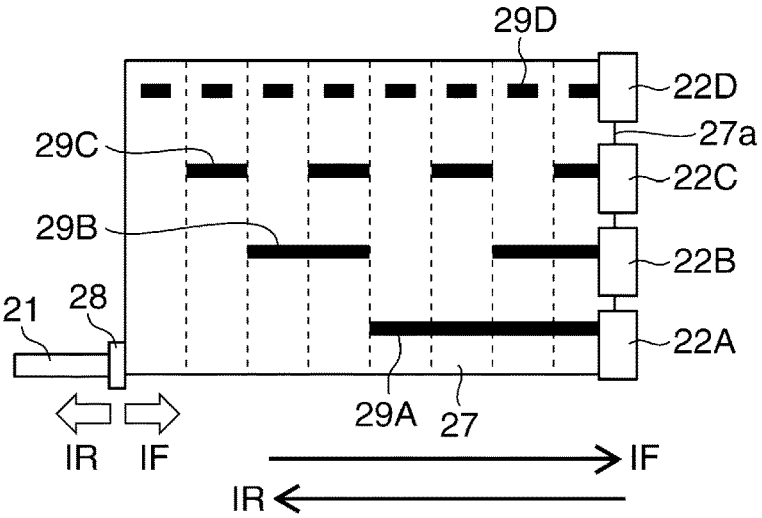
Figure 6C:
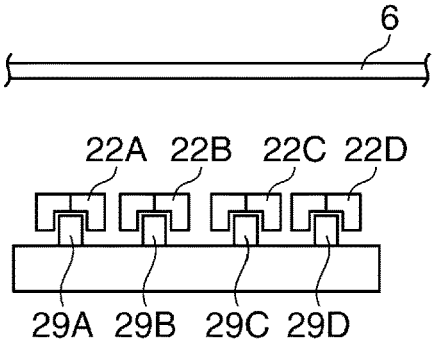

FIG. 6A, FIG. 6B, and FIG. 6C are views schematically showing a configuration of a belt-deviation-amount detecting apparatus in the second embodiment. FIG. 6A is a sectional view that is vertical to the belt conveying direction. FIG. 6B is a plan view showing a slide member shown in FIG. 6A viewed in a direction of an arrow Z. FIG. 6C is a side view showing the slide member shown in FIG. 6A viewed in a direction of an arrow X. It should be noted that an arrow IF in FIG. 6A indicates a direction of applied force that is generated when the intermediate transfer belt 6 deviates leftward in FIG. 6A, and an arrow IR indicates a direction of applied force that is generated when the intermediate transfer belt 6 deviates rightward in FIG. 6A.

As shown in FIG. 6A and FIG. 6C, a tabular slide member 27, which appears a rectangle in the plan view (FIG. 6B), is arranged under the intermediate transfer belt 6 as a moving member so as to be movable in a predetermined direction, i.e., a longitudinal direction of the rectangle. The four transmission optical sensors 22A, 22B, 22C, and 22D are arranged over a short side 27*a* that intersects perpendicularly with the moving direction of the slide member 27 along the short side 27*a*. The configurations of the transmission optical sensors 22A, 22B, 22C, and 22D are the same as that of the first embodiment mentioned above.

A plurality of projection groups 29A, 29B, 29C, and 29D are disposed on the slide member 27 along a plurality of loci of the transmission optical sensors 22A, 22B, 22C, and 22D that are formed on the slide member 27 by sliding the slide member 23 rightward or leftward in FIG. 6A. The projection groups 29A, 29B, 29C, and 29D function as the shading member groups to the transmission optical sensors 22A, 22B, 22C, and 22D. It should be noted that four light sources are disposed under the slide member 27 so as to irradiate the transmission optical sensors 22A, 22B, 22C, and 22D with light, respectively.

Figure 7:
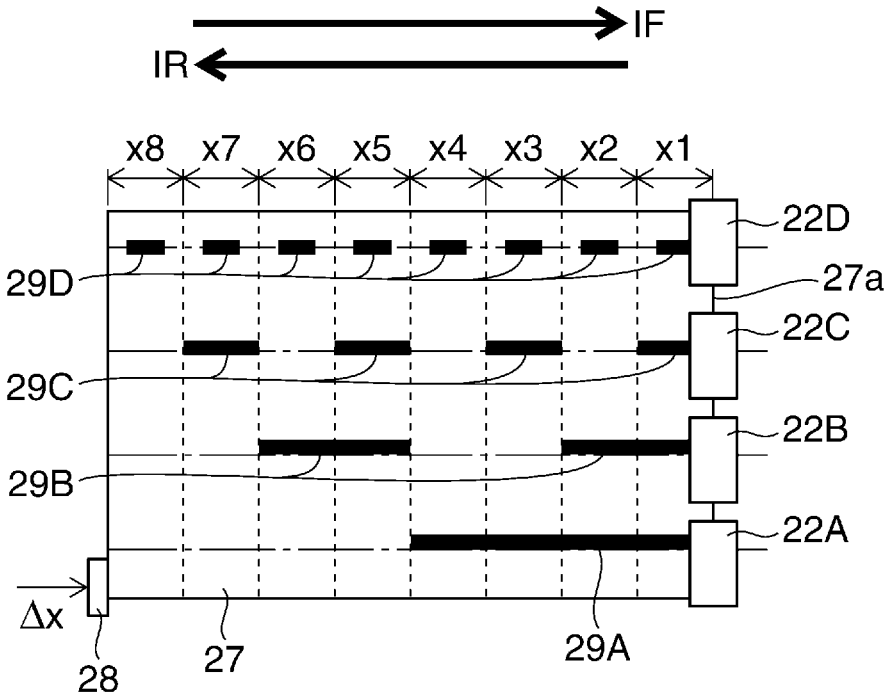
FIG. 7 is a view showing an example of an arrangement of projection groups on a slide member of the belt-deviation-amount detecting apparatus in the second embodiment.

The slide member 27 of such a configuration is equally divided into eight slide areas x1 through x8 in the slide direction (moving direction) of the slide member 27, as shown in FIG. 7 mentioned later. The reason why the slide member is divided into the eight slide areas is the same as that of the first embodiment. Accordingly, the description is omitted.

The projection groups 29A, 29B, 29C, and 20D disposed on the slide member 27 along the loci of the transmission optical sensors 22A, 22B, 22C, and 22D are arranged so that a combination of output signals of the transmission optical sensors 22A, 22B, 22C, and 22D at the time of reading is different for every slide area among the slide areas x1 through x8. Arrangement of the projection groups will be described later with reference to FIG. 7.

One end of the swinging arm 21 is in contact with the edge of the intermediate transfer belt 6 in the width direction that intersects perpendicularly with the rotating direction of the intermediate transfer belt 6. The other end is in contact with a contact surface 28 of the slide member 27. The contact surface 28 is a side surface of the slide member 27.

The swinging arm 21 swings around the swinging shaft 21*a* corresponding to the deviation amount of the intermediate transfer belt 6, and the other end that is in contact with the contact surface 28 pushes the slide member 27 and moves the slide member 27 rightward in FIG. 6B, for example. It should be noted that the slide member 27 is always energized leftward in FIG. 6B by the spring member. The combination of the projections of the projection groups 29A, 29B, 29C, and 29D that face the transmission optical sensors 22A, 22B, 22C, and 22D vary corresponding to the slide amount of the slide member 27. As a result of this, the combination of the output signals of the transmission optical sensors 22A, 22B, 22C, and 22D varies among a plurality of combinations.

FIG. 7 is a view showing an example of an arrangement of the projection groups 29A, 29B, 29C, and 29D on the slide member 27.

In FIG. 7, the four transmission optical sensors 22A, 22B, 22C, and 22D are arranged sequentially from the position near the contact surface 28 over the slide member 27 along the short side 27*a* that intersects perpendicularly with the slide direction of the side member 27. The projections of the four projection groups 29A, 29B, 29C, and 29D are disposed on the slide member 27 at the positions that respectively correspond to the transmission optical sensors 22A, 22B, 22C, and 22D so that the combination of the projections is different for every slide area among the slide areas x1 through x8.

The projection of the projection group 29A corresponding to the transmission optical sensor 22A is formed in the slide areas x1 through x4. Moreover, the projections of the projection group 29B corresponding to the transmission optical sensor 22B are formed in the slide areas x1, x2, x5, and x6. Moreover, the projections of the projection group 29C corresponding to the transmission optical sensor 22C are formed in the slide areas x1, x3, x5, and x7. Moreover, the projections of the projection group 29D corresponding to the transmission optical sensor 22D are formed in the center portion except both ends in the slide direction (moving direction) of each of the slide areas x1 through x8.

Table 3 shows the output signals of the three transmission optical sensors 22A, 22B, and 22C among the transmission optical sensors 22A, 22B, 22C, and 22D in FIG. 7 for each of the slide areas x1 through x8.

TABLE 3

| | 22A | 22B | 22C |
|---|---|---|---|
| x1 | 1 | 1 | 1 |
| x2 | 1 | 1 | 0 |
| x3 | 1 | 0 | 1 |
| x4 | 1 | 0 | 0 |
| x5 | 0 | 1 | 1 |
| x6 | 0 | 1 | 0 |
| x7 | 0 | 0 | 1 |
| x8 | 0 | 0 | 0 |

In the Table 3, the combination of the output signals of the transmission optical sensors 22A, 22B, and 22C is different in each of the eight slide areas x1 through x8. Accordingly, it is understood that the projection groups 29A, 29B, and 29C are arranged so that the combination of the output signals of the transmission optical sensors 22A, 22B, and 22C is different for every slide area.

FIG. 8A through FIG. 8H are views showing slide positions of the slide member 27 where the slide areas x1 through x8 respectively face the transmission optical sensors 22A, 22B, 22C, and 22D.

Figure 8A:
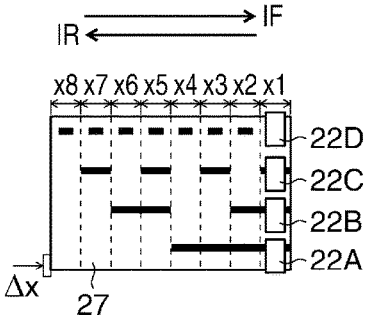
FIG. 8A through FIG. 8H are views showing slide positions of the slide member where slide areas respectively face transmission optical sensors of the belt-deviation-amount detecting apparatus in the second embodiment.
Figure 8B:
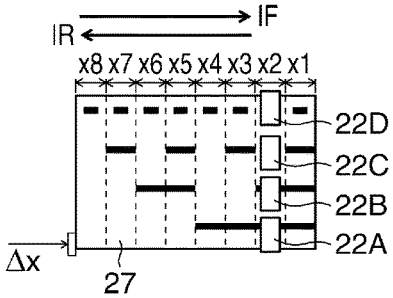
Figure 8C:
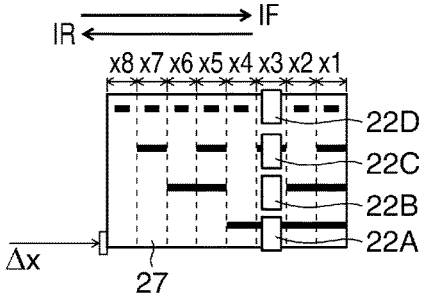
Figure 8D:
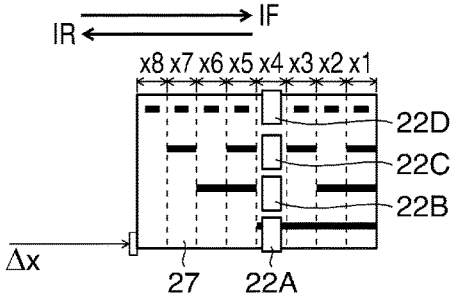
Figure 8E:
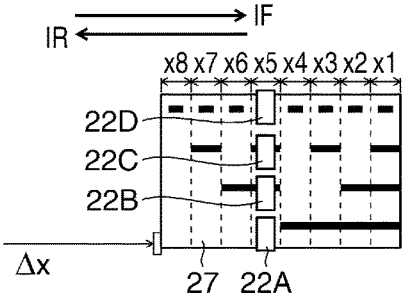
Figure 8F:
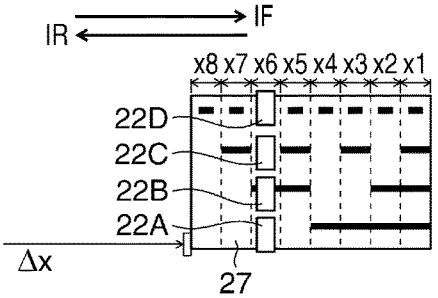
Figure 8G:
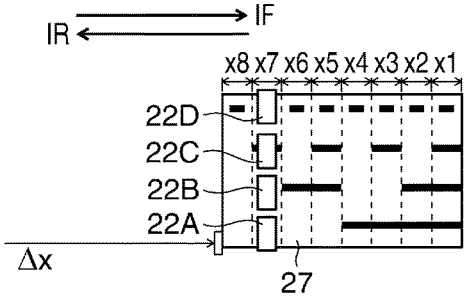
Figure 8H:
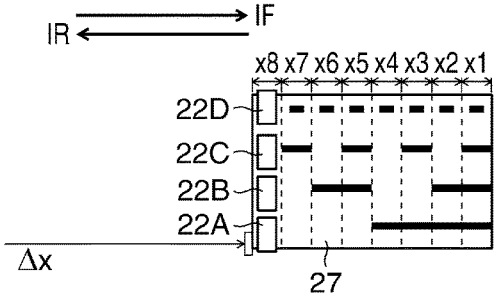

FIG. 8A shows the slide position of the slide member 27 where the slide area x1 faces the transmission optical sensors 22A, 22B, 22C, and 22D. FIG. 8B shows the slide position of the slide member 27 where the slide area x2 faces the transmission optical sensors 22A, 22B, 22C, and 22D. Moreover, FIG. 8C shows the slide position of the slide member 27 where the slide area x3 faces the transmission optical sensors 22A, 22B, 22C, and 22D. FIG. 8D shows the slide position of the slide member 27 where the slide area x4 faces the transmission optical sensors 22A, 22B, 22C, and 22D. Moreover, FIG. 8E shows the slide position of the slide member 27 where the slide area x5 faces the transmission optical sensors 22A, 22B, 22C, and 22D. FIG. 8F shows the slide position of the slide member 27 where the slide area x6 faces the transmission optical sensors 22A, 22B, 22C, and 22D. Furthermore, FIG. 8G shows the slide position of the slide member 27 where the slide area x7 faces the transmission optical sensors 22A, 22B, 22C, and 22D. FIG. 8H shows the slide position of the slide member 27 where the slide area x8 faces the transmission optical sensors 22A, 22B, 22C, and 22D.

In the belt-deviation-amount detection apparatus equipped with the slide member 27 and the transmission optical sensors 22A, 22B, 22C, and 22D of such a configuration, the deviation amount of the intermediate transfer belt 6 is detected with using the combination of the output signals of the transmission optical sensors 22A, 22B, and 22C. Namely, the deviation amount of the intermediate transfer belt 6 is detected with the combination of the output signals of M types (three types) of the transmission optical sensors corresponding to M types (three types) of the projection groups 29A, 29B, and 29C except one type among N types (four types) of the projection groups in the embodiment.

As shown in FIG. 7 and FIG. 8A through FIG. 8H, the projection of the projection group 26A is disposed in the slide areas x1 through x4, the projections of the projection group 26B are disposed in the slide areas x1, x2, x5, and x6, and the projections of the projection group 26C are disposed in the slide areas x1, x3, x5, and x7.

In the belt-deviation-amount detection apparatus of such a configuration, the slide amount Δx of the slide member 27 is detected with taking the fact that the combination of the sensor output signals is different for every slide area when the slide member 27 moves corresponding to the deviation of the intermediate transfer belt 6. Then, the deviation amount of the intermediate transfer belt 6 is detected on the basis of the slide amount Δx of the slide member 27.

However, erroneous detection may occur in a boundary of slide areas according to lack of followability to change of a measuring object of the transmission optical sensors.

Accordingly, the embodiment employs the projection group 29D, which is not applied to detect the deviation amount of the intermediate transfer belt 6 among the four projection groups, and the transmission optical sensor 22D that faces the projection group 29D to prevent erroneous detection that likely occurs near a boundary of slide areas (i.e., a boundary of deviation levels).

Table 4 shows the combinations of the output signals that are used to detect the belt deviation amount corresponding to FIG. 8A through FIG. 8H among the combinations of the output signals of the transmission optical sensors 22A, 22B, 22C, and 22D.

TABLE 4

| | 22A | 22B | 22C | 22D | SENSOR READ |
|---|---|---|---|---|---|
| x1 | 1 | 1 | 1 | 1 | READ |
| x1~x2 | — | — | — | 0 | NOT READ |
| x2 | 1 | 1 | 0 | 1 | READ |
| x2~x3 | — | — | — | 0 | NOT READ |
| x3 | 1 | 0 | 1 | 1 | READ |
| x3~x4 | — | — | — | 0 | NOT READ |
| x4 | 1 | 0 | 0 | 1 | READ |
| x4~x5 | — | — | — | 0 | NOT READ |
| x5 | 0 | 1 | 1 | 1 | READ |
| x5~x6 | — | — | — | 0 | NOT READ |
| x6 | 0 | 1 | 0 | 1 | READ |
| x6~x7 | — | — | — | 0 | NOT READ |
| x7 | 0 | 0 | 1 | 1 | READ |
| x7~x8 | — | — | — | 0 | NOT READ |
| x8 | 0 | 0 | 0 | 1 | READ |

As shown in the table 4, only when the output signal of the transmission optical sensor 22D is "1", the output signals of the transmission optical sensors 22A, 22B, and 22C are read, and the moving amount Δx of the slide member 27 that corresponds to the deviation amount of the intermediate transfer belt 6 is detected.

On the other hand, when the output signal of the transmission optical sensor 22D is "0", the output signals of the other sensors are not read, and the previous moving amount Δx that has been detected at the last time is continuously used as the moving amount of the slide member 27. This prevents erroneous detection because the output signals detected near a boundary of slide areas (deviation levels) are excepted from the detection process of the moving amount Δx of the slide member 27.

Figure 9:
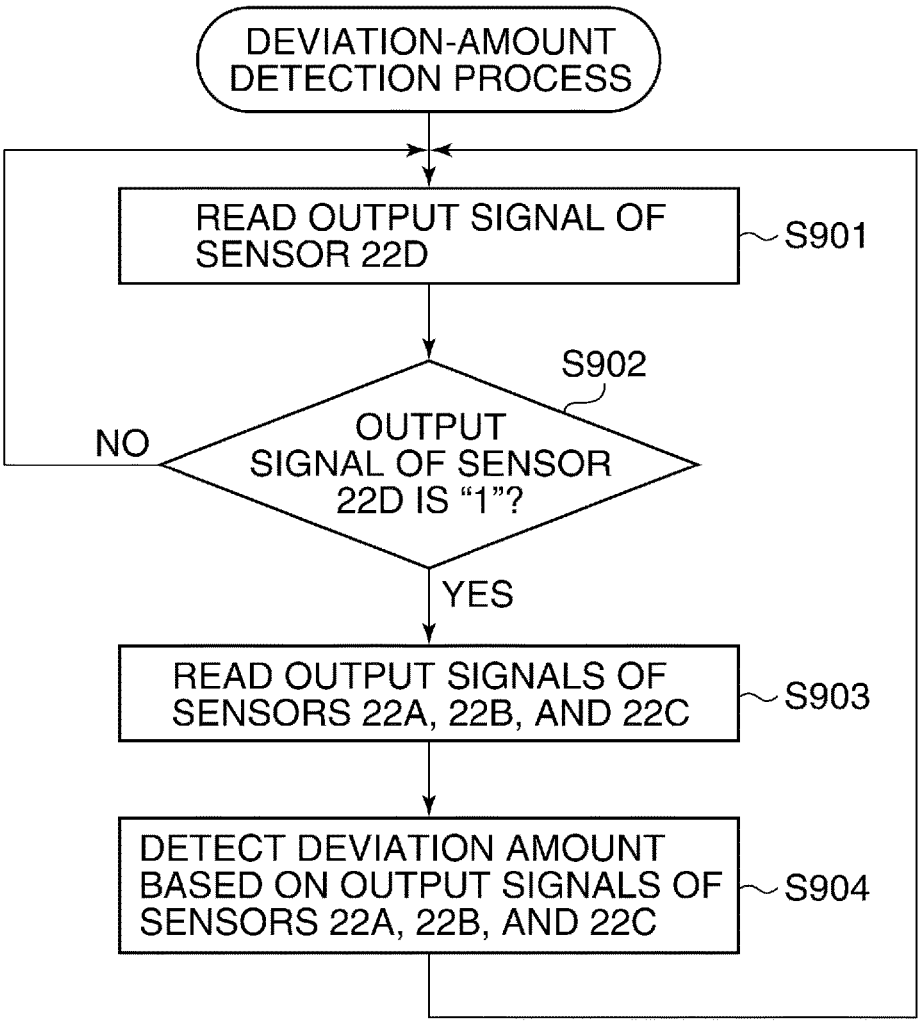
FIG. 9 is a flowchart showing a deviation amount detection process by the belt-deviation-amount detecting apparatus in the second embodiment.

FIG. 9 is a flowchart showing the deviation amount detection process by the belt-deviation-amount detecting apparatus in the second embodiment. When the process is started, the output signal of the transmission optical sensor 22D is read in step S901. Next, it is determined whether the output signal of the transmission optical sensor 22D is "1". When the output signal of the transmission optical sensor 22D is "0" (NO in the step S902), the process returns to the step S901. On the other hand, when the output signal of the transmission optical sensor 22D is "1" (YES in the step S902), the process proceeds to step S903 and the output signals of the transmission optical sensors 22A, 22B, and 22C are read. After that, the process proceeds to step S904, and the deviation amount (moving amount) is detected on the basis of the read output signals of the transmission optical sensors 22A, 22B, and 22C.

In the embodiment, shading parts of M types (three types) of the shading member groups are disposed in the plurality of areas formed by dividing the slide member that moves depending on the deviation amount of the intermediate transfer belt 6 so that the output signals of M pieces of corresponding optical sensors give $2^M$ (eight) combinations. Moreover, a shading part of one shading member group other than the above-mentioned shading member groups is formed in the center portion except both ends in the slide direction in each of the divided eight areas. Then, the moving amount Δx of the slide member 27 that moves according to the deviation of the intermediate transfer belt that corresponds to the deviation amount of the intermediate transfer belt is detected with using the combination of the output signals of three pieces of the sensors at the time when the transmission optical sensor 22D that faces the one shading member group outputs the predetermined signal "1". This prevents erroneous detection near a boundary of deviation levels. Moreover, the excessive deviation error resulting from the correction based on erroneous detection, breakage of the belt by running on the end member, etc. are prevented.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-242984, filed Dec. 14, 2015, which is hereby incorporated by reference herein in its entirety.

What is claimed is:

1. A position detection apparatus that detects a position of a target object in a predetermined direction, the position detection apparatus comprising:

a swinging member of which one end is in contact with the target object in the predetermined direction;

a moving member that is in contact with another end of said swinging member;

(M +1) pieces of sensors that are arranged in a direction that intersects a moving direction of said moving member and output signals corresponding to a position of said moving member that corresponds to a swinging amount of said swinging member; and a detection unit configured to detect the position of the target object based on the output signals of said sensors, wherein said moving member has a plurality of measured parts disposed on said moving member along a plurality of loci of measuring positions of said sensors formed on said moving member during movement of said moving member, wherein said detection unit detects the position of the target object based on the output signals of M pieces of sensors among said (M +1) pieces of sensors in a case where a predetermined sensor other than the M pieces of sensors outputs a predetermined signal, and wherein the measured parts corresponding to the measuring position of the predetermined sensor are provided in $2^M$ pieces of divided areas that are disposed along a locus corresponding to the predetermined sensor, and each of the measured parts corresponding to the measuring position of the predetermined sensor is disposed in a center portion except both ends in the moving direction in each of the divided areas.

2. The position detection apparatus according to claim 1, wherein said moving member is a fan-shaped rotating member, and the measured parts are disposed on circular arcs of different radii around a rotating shaft of the rotating member.

3. The position detection apparatus according to claim 2, wherein the another end of said swinging member is in contact with a side surface of a circular arc portion of said rotating member, and rotates the rotating member around a pivot of a fan shape by pushing the side surface corresponding to the moving amount of the target object.

4. The position detection apparatus according to claim 1, wherein said moving member is a tabular slide member.

5. The position detection apparatus according to claim 4, wherein the another end of said swinging member is in contact with a side surface of the tabular slide member, and moves the tabular slide member in a predetermined direction by pushing the side surface corresponding to the moving amount of the target object.

6. A position detection apparatus that detects a position of a target object in a predetermined direction, the position detection apparatus comprising:

a swinging member of which one end is in contact with the target object in the predetermined direction;

a moving member that is in contact with another end of said swinging member;

(M +1) pieces of sensors that are arranged in a direction that intersects a moving direction of said moving member and output signals corresponding to a position of said moving member that corresponds to a swinging amount of said swinging member; and a detector configured to detect the position of the target object based on the output signals of said sensors, wherein said moving member has a plurality of measured parts disposed on said moving member along a plurality of loci of measuring positions of said sensors formed on said moving member during movement of said moving member, wherein said detector detects the position of the target object based on the output signals of M pieces of sensors among said (M +1) pieces of sensors in a case where a predetermined sensor other than the M pieces of sensors outputs a predetermined signal, and wherein the measured parts corresponding to the measuring position of the predetermined sensor are provided in $2^M$ pieces of divided areas that are disposed along a locus corresponding to the predetermined sensor, and each of the measured parts corresponding to the measuring position of the predetermined sensor is disposed in a center portion except both ends in the moving direction in each of the divided areas.

7. The position detection apparatus according to claim 6, wherein said moving member is a fan-shaped rotating member, and the measured parts are disposed on circular arcs of different radii around a rotating shaft of the rotating member.

8. The position detection apparatus according to claim 7, wherein the another end of said swinging member is in contact with a side surface of a circular arc portion of said rotating member, and rotates the rotating member around a pivot of a fan shape by pushing the side surface corresponding to the moving amount of the target object.

9. The position detection apparatus according to claim 6, wherein said moving member is a tabular slide member.

10. The position detection apparatus according to claim 9, wherein the another end of said swinging member is in contact with a side surface of the tabular slide member, and moves the tabular slide member in a predetermined direction by pushing the side surface corresponding to the moving amount of the target object.

* * * * *